US007154487B2

(12) United States Patent
Gu

(10) Patent No.: US 7,154,487 B2
(45) Date of Patent: Dec. 26, 2006

(54) POWER SAVING PALETTE LOOK-UP TABLE FOR GRAPHICS CONTROLLER

(75) Inventor: Jin-Ming (James) Gu, Cupertino, CA (US)

(73) Assignee: S3 Graphics Co., Ltd. (KN)

( * ) Notice: Subject to any disclaimer, the term of this patent is extended or adjusted under 35 U.S.C. 154(b) by 222 days.

(21) Appl. No.: 10/302,101

(22) Filed: Nov. 21, 2002

(65) Prior Publication Data

US 2004/0100458 A1 May 27, 2004

(51) Int. Cl.
*G09G 5/00* (2006.01)

(52) U.S. Cl. ..... 345/204; 345/211; 345/601; 345/602; 345/690

(58) Field of Classification Search ..... 345/87, 345/88, 89, 204, 211–212, 600–602, 690–693
See application file for complete search history.

(56) References Cited

U.S. PATENT DOCUMENTS 5,515,480 A * 5/1996 Frazier ..... 358/1.9
5,710,836 A * 1/1998 Shiau et al. ..... 382/237
6,169,533 B1 * 1/2001 Tse ..... 345/638
6,765,614 B1 * 7/2004 Matsukawa ..... 348/246
2002/0135550 A1 * 9/2002 Pfeiffer et al. ..... 345/87
2004/0041825 A1 * 3/2004 Willis ..... 345/694

* cited by examiner

*Primary Examiner*—Richard Hjerpe
*Assistant Examiner*—Kimnhung Nguyen
(74) *Attorney, Agent, or Firm*—Anthony B. Diepenbrock, III; Dechert LLP

(57) ABSTRACT

A system for generating compensation pixel data for pixel data having adjacent values. The compensation pixel data is the pixel data adjusted by a value in order to perform an effect with the pixel data. The system has a comparator for determining whether the pixel data varies between adjacent values. Furthermore, the system includes a look-up table in communication with the comparator. The look-up table replaces the subsequent value of the pixel data with the compensation pixel data only when the preceding value of the pixel data is different than the subsequent value thereby reducing the number of look-ups for the compensation pixel data.

20 Claims, 4 Drawing Sheets

POWER SAVING PALETTE LOOK-UP TABLE FOR GRAPHICS CONTROLLER

BACKGROUND OF THE INVENTION

1. Field of the Invention

The present invention generally relates to a system and method for saving power when looking up pixel compensation values and more particularly to a system and method which saves power during the look-up process for gamma compensation pixel data.

2. Description of the Related Art

A graphics controller is used to process video data for a computer system in order to display the data on a monitor. Referring to FIG. 1, a graphics controller 10 for converting graphics data from a CPU 12 for display on a monitor 14 is shown. The graphics controller 10 communicates with the CPU 12 through a PCI/AGP bus 16. The bus 16 communicates with a graphics engine and video engine 18 to process data/command signals from the CPU 12 and generate visible pixel data on the monitor 14. For example, the video engine decodes compressed video data to video pixel data, and the graphics engine executes CPU commands to generate graphics data that draws the desired shape on the monitor. Accordingly, the graphics engine and video engine 18 processes the abstract data from the CPU into pixel/graphics data.

The pixel/graphics data processed by the graphics and video engine 18 is transferred to a memory 20 for temporary storage. A display processor 22 of the graphics controller 10 reads the pixel/graphics data from the memory 20. Specifically, the display processor 22 takes the pixel/graphics data from the memory 20 and processes the data with a graphics and video processor 24 into RGB:888 digital data. A digital-to-analog converter (DAC) 26 converts the RGB:888 digital data into RGB analog signals that are displayed on the monitor 14. For example, the pixel data in the memory 20 may be in RGB:8 (pseudo color), RGB:565, RGB:888 or RGB:x888 bit format. The graphics and video processor 24 will convert the graphics pixel data into the RGB:888 bit format. Alternatively, the graphics and video processor 24 can convert the video pixel data from YCbCr:422, YCbCr:420 bit formats into the RGB:888 bit format. The graphics and video processor 24 can also merge the graphics pixel data with the video pixel data for display on the monitor 14.

After processing by the graphics and video processor 24, the RGB:888 data may be gamma compensated for display on various monitors. Specifically, the gamma compensation adjusts for non-linear differences in pixel brightness levels between different monitors. A look-up table (LUT) 28 of the display processor 22 applies the gamma compensation to the pixel data before being converted to RGB analog signals by the DAC 26. The LUT 28 adjusts the pixel data to achieve consistent brightness on the monitor 14.

Referring to FIG. 2, the configuration for a prior art LUT 28 is shown. The LUT 28, receives pixel data [23:0] from the graphics and video processor 24. The pixel data is separated into 8 bit color components Red_data, Green_data, and Blue_data which are used to address respective Synchronous (Sync) RAMs 30*a*, 30*b*, and 30*c*. Specifically, at system startup, the Sync RAMs 30*a*, 30*b*, and 30*c* are loaded with gamma compensation pixel data for the monitor 14. The pixel data Red_data, Green_data, and Blue_data address a respective Sync RAM 30*a*, 30*b* and 30*c* in order to read the gamma compensation pixel data contained therein. In this regard, each Sync RAM 30*a*, 30*b*, and 30*c* generates respective gamma compensation pixel data Red_LUTout, Green_LUTout, and Blue_LUTout. The output data (Red_LUTout, Green_LUTout, and Blue_LUTout) from each Sync RAM 30*a*, 30*b*, 30*c* are converted to analog signals by the DAC 26 and then combined for display by the monitor 14. If there is no gamma compensation pixel data for the monitor 14, then the pixel data can bypass the LUT 28 and go directly to the DAC 26. If the graphics data is in pseudo color format, then the LUT 28 can also be used to convert the 8 bit pseudo color data into 24 bit true color data. Furthermore, it is also possible to use the LUT 28 for other types of graphics/video processing. For instance, the LUT 28 can be used to achieve a negative affect on the monitor by loading the Sync RAMs 30*a*, 30*b*, and 30*c* with appropriate compensation pixel data to achieve the desired effect.

A disadvantage of the prior art LUT 28 is that power consumption is excessive during the look-up process. Every time the pixel data addresses the LUT 28 in order to generate the compensation pixel data, the LUT 28 consumes power. In the prior art LUT 28, each pixel is used to check the LUT 28 for compensation pixel data such that power is always being consumed.

However, if the LUT 28 is not looking-up data, very little power is consumed. It will be recognized that power savings become very important as the size of graphics controllers are increasing. By reducing the power consumption of the graphics controller, the heat and temperature generated by the system can be reduced and the battery life can be increased.

The present invention addresses the above-mentioned deficiencies in the prior art graphics processing system by providing a system and method which reduces the power needed for gamma compensation by the graphics controller 10. Specifically, the present invention provides a system and method whereby addressing and lookup of compensation pixel data is minimized thereby resulting in a power savings for the graphics controller 10.

BRIEF SUMMARY OF THE INVENTION

In accordance with the present invention there is provided a system for generating compensation pixel data for pixel data having adjacent values. The compensation pixel data may correspond to the pixel data adjusted by a gamma compensation value or some other value in order to perform an effect on the pixel data. The system has a comparator for determining whether the pixel data varies between adjacent values. Furthermore, the system includes a look-up table in communication with the comparator. The look-up table is operative to generate the compensation pixel data for the pixel data only when the comparator determines that a subsequent value of the pixel data is different than a previous value of the pixel data. The look-up table will replace the subsequent value of the pixel data with the compensation pixel data only when the preceding value of the pixel data is different than the subsequent value of the pixel data.

In the preferred embodiment, the look-up table is a random access memory containing the values of the compensation pixel data that may be the pixel data adjusted by a gamma compensation value. The pixel data is used as an address to the random access memory in order to access the corresponding compensation pixel data. The system may further include a control circuit in electrical communication with the comparator and the look-up table. The control circuit is operative to generate a read signal to the look-up table when the subsequent value of the pixel data is different than the previous value of the pixel data.

In accordance with the present invention there is provided a method for generating compensation pixel data for pixel data having multiple values with a comparator and look-up table. The method begins by comparing the adjacent values of the pixel data to determine if they are identical. Next, the compensation pixel data is looked-up in the look-up table if the pixel data is different between a subsequent value of the pixel data and a preceding value of the pixel data. Finally, the compensation pixel data will be designated as the pixel data for the subsequent pixel data when the adjacent values of the pixel data are different. The pixel data may be a stream of pixel data containing multiple adjacent values such that the method further includes comparing and replacing the pixel data in the stream of pixel data with the compensation pixel data when the subsequent and preceding values of the pixel data are different.

In one embodiment, the present invention is a system for generating compensation pixel data. The system includes a comparator, a look-up table, selection circuitry, and a control circuit. The comparator has inputs that receive data for successive pixels, where the pixel data has values affecting the appearance of the pixels, and is operative to compare pixel data values between adjacent pixels to determine whether the values are the same or different. The look-up table maps pixel data to compensation pixel data and is operative, when enabled, to supply the compensation pixel data to a compensation pixel data output. The selection circuitry is coupled between the look-up table and a pixel data output, and is operative to select, when enabled, for the pixel data output the compensation pixel data from the compensated pixel data output and to hold previously selected compensation pixel data on the pixel data output, otherwise. The control circuit is coupled to the comparator, the look up table, and the selection circuitry, and is configured to enable the look-up table to supply the compensation pixel data on the compensated pixel data output and enable the selection circuitry to select the compensation pixel data output, where the enabling of the look-up table and selection circuitry occurs when the comparator indicates that the pixel data values are different between adjacent pixels and disabling of the look up table to save power occurs when the pixel data values are the same between adjacent pixels.

In another embodiment, the present invention is a method for generating composition pixel data, where the method includes the steps of (i) comparing the values of pixel data of adjacent pixels to determine if they differ, (ii) looking-up compensation pixel data in a look-up table if the values of pixel data differ between adjacent pixels, (iii) selecting the compensation pixel data from the look-up table for output if the values of pixel data differ between adjacent pixels, and (iv) disabling the look-up table to save power and holding at an output previously selected compensation pixel data, if the values of pixel data for adjacent pixels are the same.

BRIEF DESCRIPTION OF THE DRAWINGS

These as well as other features of the present invention will become more apparent upon reference to the drawings wherein.

DETAILED DESCRIPTION OF THE INVENTION

Figure 3:
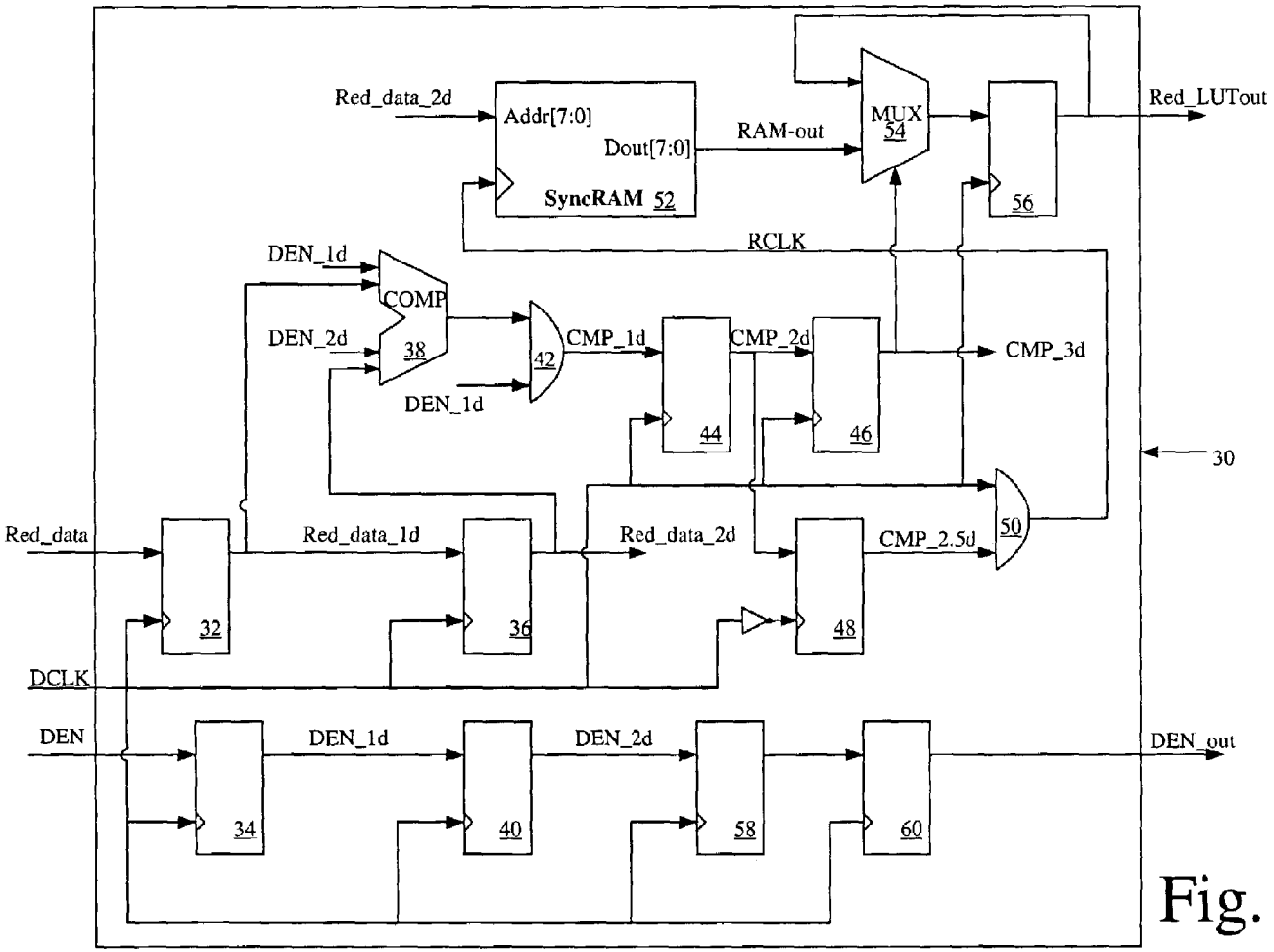
FIG. 3 is a structure for a look-up table cell constructed in accordance with the present invention.

Referring to the drawings wherein the showings are for purposes of illustrating a preferred embodiment of the present invention only, and not for purposes of limiting the same, FIG. 3 is the structure of a look-up table (LUT) cell 30 for Red_data. In this regard, the cell 30 determines the gamma compensation pixel data for red pixel data. The present invention is being described as generating gamma compensation pixel data. However, it will be recognized by those of ordinary skill in the art that the present invention may also be used to generate other effects on the pixel data, and that gamma compensation pixel data is just one example of such an effect.

In the preferred embodiment of the present invention, the look-up table 28 used in the display processor 22 of the graphics controller 10 will contain the LUT cell 30 for each color. For example, the display processor 22 will have a LUT cell 30 for each of the red pixel data, green pixel data and blue pixel data. However, for simplicity, the present invention is being described and shown only for the red pixel data. It will be recognized by those of ordinary skill in the art that the LUT cell 30 can be used for green or blue pixel data as well. Accordingly, in the preferred embodiment of the present invention, the LUT 28 shown in FIG. 1 will have three LUT cells 30 (e.g., a respective LUT cell 30 for each of the red pixel data, the blue pixel data, and the green pixel data).

Figure 1:
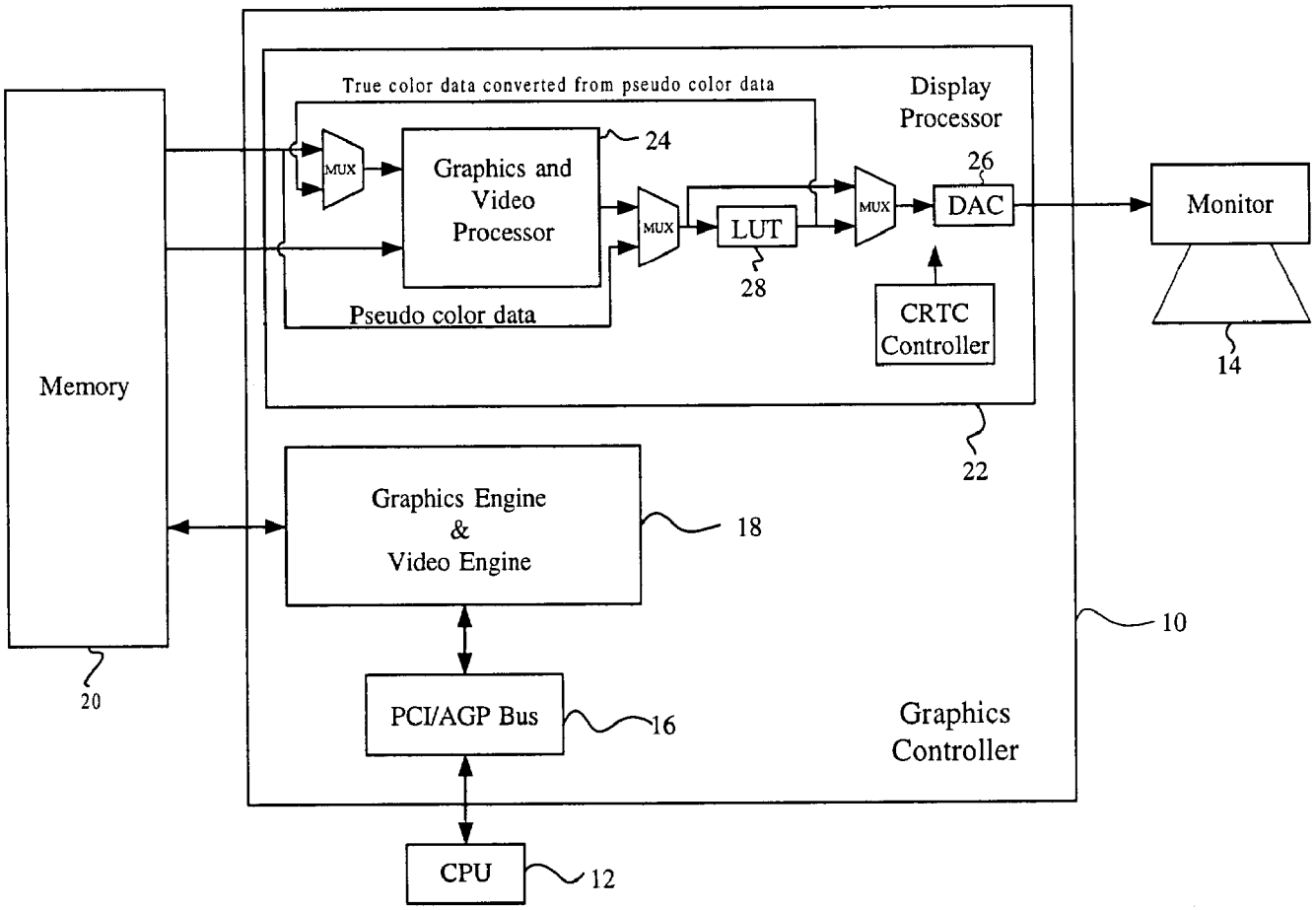
Fig. 1 (Prior Art)
FIG. 1 is a general structure of a graphics controller.
Figure 2:
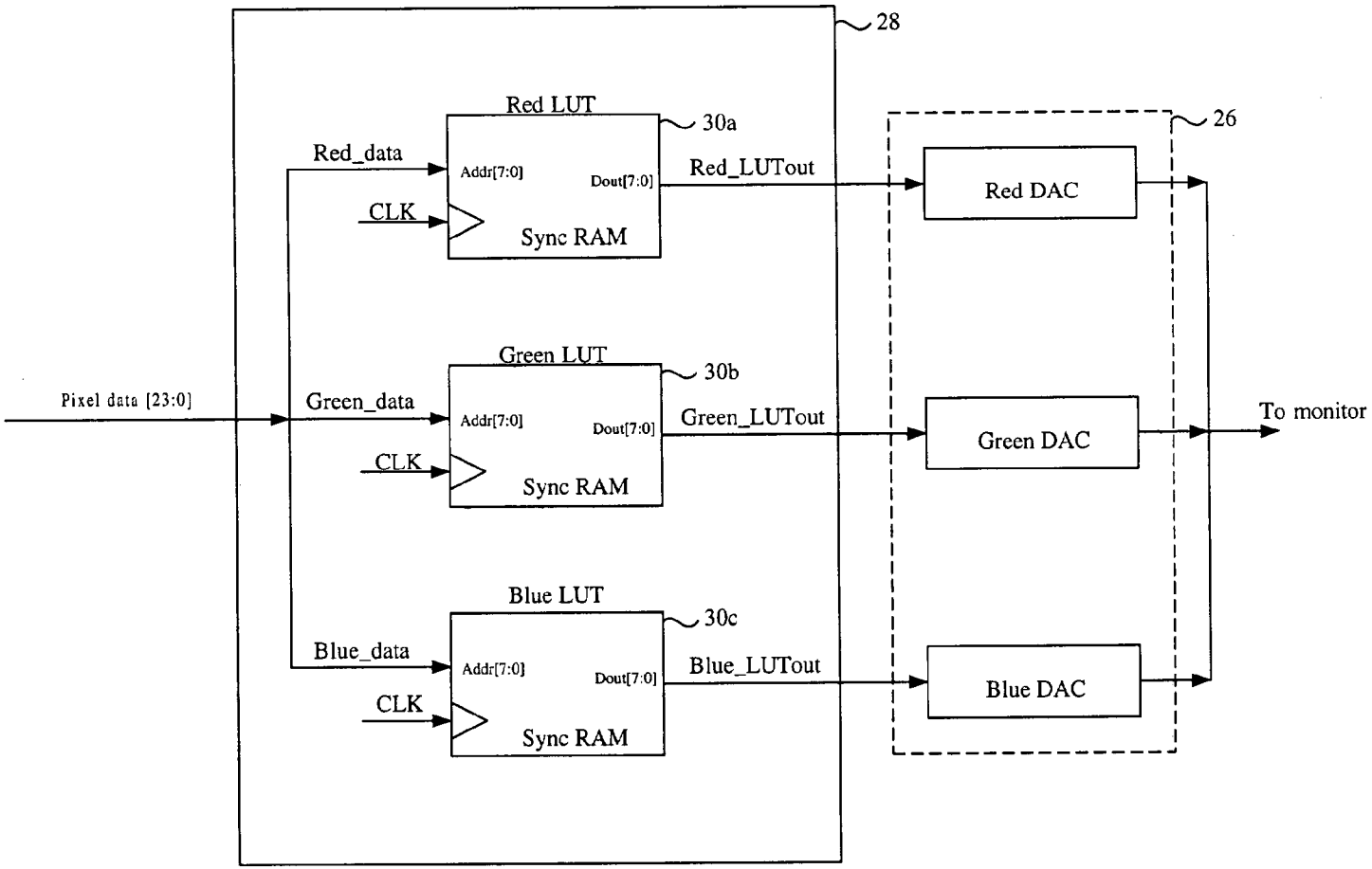
Fig. 2 (Prior Art)
FIG. 2 is a structure of a prior art look-up table for the graphics controller shown in FIG. 1.

The LUT cell 30 is operative to compare adjacent pixel data in order to save power. Because adjacent pixels displayed on the monitor 14 may have the same value, the gamma compensation for these pixels will be the same. Accordingly, it is not necessary to look-up the gamma compensation pixel data between adjacent pixels when the pixel data does not change. The LUT cell 30 shown in FIG. 1 provides logic for comparing subsequent pixel data with previous pixel data in order to determine whether the value has changed and new gamma compensation pixel data needed. If the value between adjacent pixel data has changed, then new gamma compensation pixel data is looked-up in the table and outputted. However, if the value between adjacent pixel data has not changed, then new gamma compensation pixel data is not needed and not looked-up thereby saving power. By only looking-up gamma compensation pixel data when the pixel data between adjacent pixels has changed, it is possible to achieve an 80% power saving depending on the content of the image. For example, in static images, the value of pixel data does not change such that fewer look-ups are needed.

Referring to FIG. 3, the LUT cell 30 has a first input pixel data delay register 32 for receiving the pixel data (Red_data) from the graphics and video processor 24. The output (Red_data_1*d*) of the first input pixel data register 32 is inputted into a second pixel data delay register 36 which generates a Red_data_2*d* signal. Both of these output signals Red_data_1*d* and Red_data_2*d* are inputted into a comparator 38.

A data enable signal DEN from the graphics and video processor 24 is delayed by a first data enable delay register 34 to generate a first data enable delay signal DEN_1*d*. The first data enable delay signal DEN_1*d* is inputted into a second data enable delay register 40 to generate a second data enable delay signal DEN_2*d*. Both the first data enable delay signal DEN_1*d* and the second data enable delay signal DEN_2*d* are inputted into the comparator 38. The data enable delay signal is delayed two more times with a third data enable delay register 58 and a fourth data enable delay register 60 in order to correlate the timing of the data enable signal with the output of the pixel data, as will be further explained below.

When both DEN_1*d* and DEN_2*d* are high, the comparator 38 will compare the signals Red_data_1*d* and Red_data_2*d* to determine if the value of the pixel data has changed between the adjacent pixels. As will be further explained below, Red_data_2*d* is the value of a first (or previous) pixel, and Red_data_1*d* is the value of a second (or subsequent) pixel. The comparator 38 determines whether the value of the pixel data is the same between these two adjacent pixels. The data enable signal is used along with the pixel data in the comparator 38 in order to ensure that the first pixel of every scan line is always checked out from the LUT. The comparator 38 outputs a high value if the comparison between the Red_data_1*d* and the Red_data_2*d* is different and outputs a low value if the comparison between Red_data_1*d* and Red_data_2*d* is the same.

The output of the comparator 38 is connected to an input of a first AND gate 42. Similarly, the first data enable delay signal DEN_1*d* is connected to another input of the AND gate 42. The first AND gate 42 generates a first comparator output CMP_1*d* that is high when the comparison between the Red_data_1*d* and the Red_data_2*d* is different and the first data enable delay signal DEN_1*d* is high. A first comparator delay register 44 generates a CMP_2*d* signal by delaying the CMP_1*d* signal by one clock cycle. A second comparator delay register 46 delays the CMP_2*d* signal by one clock cycle in order to generate a CMP_3*d* signal.

The CMP_2*d* signal is inputted into an RCLK register 48 that is toggled by an inverse DCLK signal. The RCLK register 48 is operative to generate a CMP__2.5d signal which is the same as the CMP_2*d* signal but delayed by one-half clock cycle. The output of the RCLK register 48 is one input into a second AND gate 50. The other input of the AND gate 50 is the DCLK signal. The second AND gate 50 generates an RCLK signal which is the input to SYNC RAM 52. The SYNC RAM 52 is loaded at system startup with the values for gamma compensation pixel data for the monitor 14 or any other compensation pixel data desired. The pixel data Red_data_2*d* from the second pixel data delay register 36 is used to address the location of compensation pixel data in the SYNC RAM 52. In this regard, the SYNC RAM 52 generates the gamma compensation pixel data from the contents stored therein.

The RCLK signal from the second AND gate 50 is used to perform the reading operation in the SYNC RAM 52. As previously explained above, the RCLK signal is generated from the CMP_1*d* signal in response to whether Red_data_1*d* and Red_data_2*d* are the sa the Red_data_1*d* and Red_data_2*d* are not the same, then the RCLK signal will be high and the SYNC RAM 52 will look-up the gamma compensation pixel data for the Red_data_2*d*. On the other hand, if Red_data_1*d* and Red_data_2*d* are the same, then the SYNC RAM 52 will be inactive and no look-up will be performed. Accordingly, the only time the SYNC RAM 52 will perform a look-up is when there is a difference between adjacent pixel data of the Red_data signal.

The output (RAM-out) of the SYNC RAM 52 is an input to a 2×1 multiplexer 54. The output of the multiplexer 54 is an input to an output register 56. The output register 56 is toggled with the DCLK signal. The final compensated pixel data signal Red_LUTout is generated by the output register 56 and is fed back into the multiplexer 54. The input to the multiplexer is selected by the CMP_3*d* signal. For example, the CMP__3d signal can either select the RAM-out signal or the Red_LUTout signal depending on whether the pixel value of the Red_data has changed. If the pixel value has changed, then the multiplexer will select the RAM-out signal which indicates that the new compensation pixel data from the Sync RAM 52 should be used. However, if the value of the pixel data has not changed, then the multiplexer will select the Red_LUTout signal. The multiplexer 54 and the register 56 define a feedback loop wherein the output pixel data Red_LUTout will not change if the pixel data is the same. However, when the pixel data changes, the multiplexer 54 will select the RAM-out signal which contains the pixel compensation data.

Figure 4:
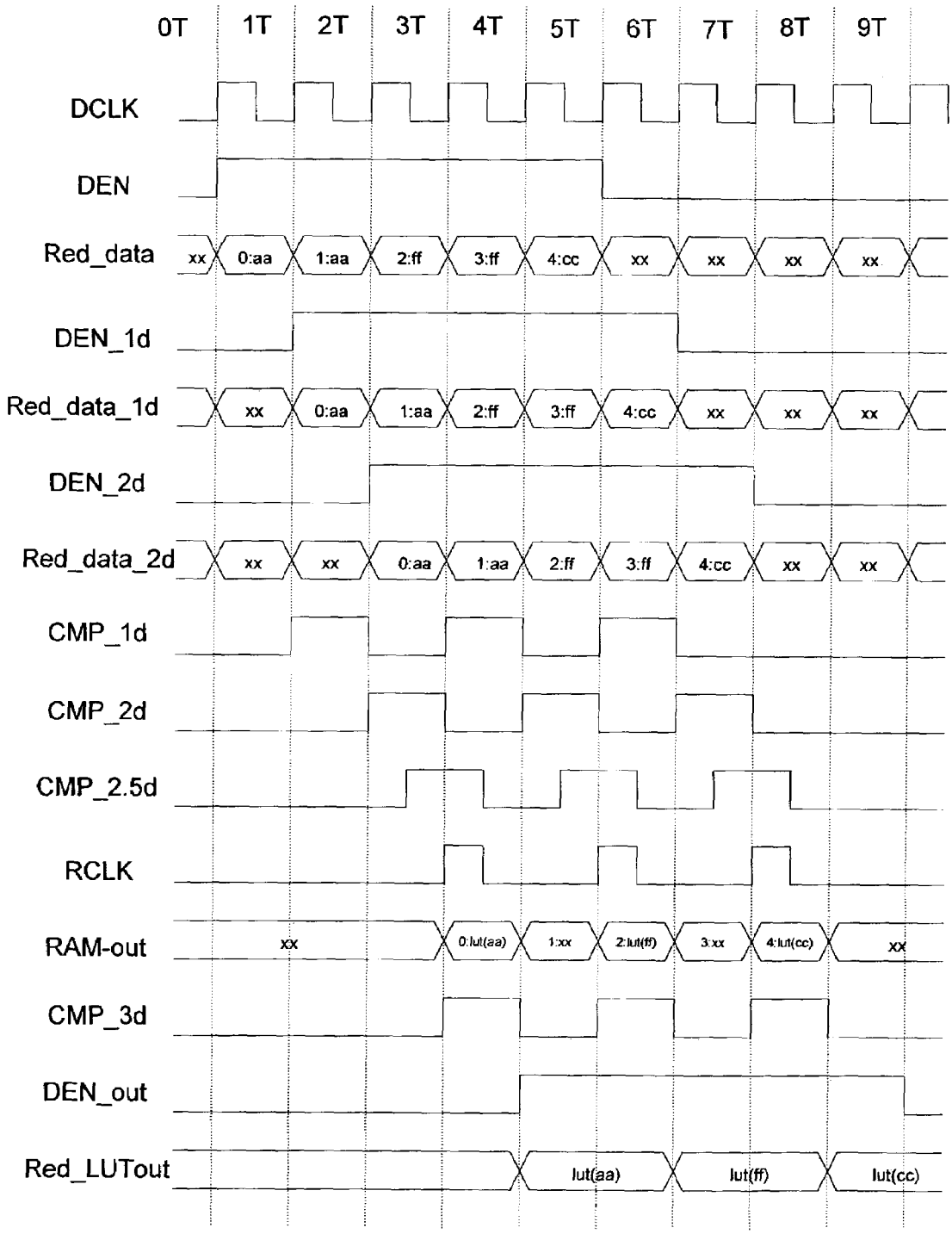
FIG. 4 is a timing diagram for the look-up table cell shown in FIG. 3.

Referring to FIG. 4, a timing diagram for the look-up table cell 30 is shown. By way of example, the sequence (or stream) of bytes for 8 bit Red_data is . . . xx, 0:aa, 1:aa, 2:ff, 3:ff, 4:cc, xx . . . . The byte preceding the zero byte has a value of xx and the zero byte has a value of aa. The first byte has the same value of Red_data (e.g., aa) as the zero byte, whereas the second and third bytes have the same value (e.g., ff). Therefore, there is a difference in the value between the byte preceding the zero byte (e.g., xx) and the zero byte (e.g., aa). Accordingly, the CMP_1*d* waveform is high when the Red_data_1*d* signal is 0:aa and the Red_data__2signal is xx. As can be seen in FIG. 4, the CMP_2*d* signal is high one clock cycle later than the CMP_1*d* signal and the CMP_2.5*d* signal is high after one-half of a clock cycle. The RCLK signal is high on the next high signal from the DCLK and one-half of a clock cycle later than the CMP__2.5 signal. The RCLK signal enables the SYNC RAM 52 to look-up the RAM-out value 0:lut(aa). Finally, when the CMP__3d signal goes low, the Red_LUTout signal outputs the compensation pixel data lut(aa) which is for the 0:aa byte of the Red_data signal. Therefore, the value of the zero byte has been compensated from aa to lut(aa). The value of lut(aa) is the value of the compensation pixel data contained in the Sync RAM 52.

As can be seen in FIG. 4, the Red_LUTout signal remains as lut(aa) until the valued changes to lut(ff). This is the result of the difference between the 1:aa and 2:ff bytes in the Red_data. The SYNC RAM 52 performs a look-up only when the change between the adjacent bytes occurs. The previous and subsequent bytes are compared in order to determine if a look-up of pixel compensation data is needed. As such, when the RCLK signal transitions to a high state, the SYNC RAM 52, performs the look-up operation.

The RCLK signal only transitions for three times for the example pixel data stream shown in FIG. 4. The first time is for the initial lookup for the 0:aa byte, the next transition is for the difference between the 1:aa and 2:ff bytes and the third transition is for the difference between the 3:ff and 4:cc bytes. At the clock cycle 5T, because the Red_data_1*d* and Red_data_2*d* are the same, the RCLK signal is low such that no RAM-out data is checked out from the SYNC RAM 52. The same situation also occurs at clock cycle 7T. As such, because there are only three changes between the five bytes, only three look-ups are needed. As previously discussed, for the prior art LUT system, each byte would have been looked-up in the SYNC RAM 52. Accordingly, the LUT cell 30 saves energy by providing a look-up only when the bytes in the Red_data change.

In the present invention, 3 LUT cells 30 are included for the various colors (i.e., red, blue, or green) and function separately; i.e., the red data, green data, and blue data are compared separately. For example, if the red data is the only data to change, then new red LUT data is checked out without checking out blue or green LUT data. In this respect, the power savings are greater.

It is also possible to compare the red data, green data, and blue data all together. In such an arrangement, all of the red, green, and blue LUT data will be checked out if any color is different. For example, if the red data is the only one to change, then new red, blue and green LUT data are all checked out.

Additional modifications and improvements of the present invention may also be apparent to those of ordinary skill in the art such as using a FIFO instead of a Sync RAM. Thus, the particular combination of parts describes and illustrated herein is intended to represent only a certain embodiment of the present invention, and is not intended to serve as a limitation of alternative devices within the spirit and scope of the invention.

What is claimed is:

1. A system for generating compensation pixel data, the system comprising:

a comparator having inputs that receive data for successive pixels, the pixel data having values affecting the appearance of the pixels, the comparator operative to compare pixel data values between adjacent pixels to determine whether the values are the same or different;

a look-up table that maps pixel data to compensation pixel data and is operative, when enabled, to supply the compensation pixel data to a compensation pixel data output;

selection circuitry coupled between the look-up table and a pixel data output, operative to select, when enabled, for the pixel data output the compensation pixel data from the compensated pixel data output and to hold previously selected compensation pixel data on the pixel data output, otherwise; and a control circuit coupled to the comparator, the look up table, and the selection circuitry, the control circuit configured to enable the look-up table to supply the compensation pixel data on the compensated pixel data output and enable the selection circuitry to select the compensation pixel data output, wherein enabling of the look-up table and selection circuitry occurs when the comparator indicates that the pixel data values are different between adjacent pixels and disabling the look up table to save power occurs when the comparator indicates that the pixel data values are the same between adjacent pixels.

2. The system of claim 1, wherein the look-up table is a random access memory.

3. The system of claim 2, wherein the random access memory is enabled by a read signal.

4. The system of claim 2, wherein the pixel data is an address for the compensation pixel data in the random access memory.

5. The system of claim 1, wherein the compensation pixel data is the pixel data adjusted by a gamma compensation value for the pixel data.

6. The system of claim 1, wherein the pixel data comprises multiple adjacent values of the pixel data.

7. A system for generating compensation pixel data as recited in clam 1, wherein the selection circuitry includes:

an output register that captures input data to provide data at the pixel data output; and a multiplexer having an output connected to the input of the output register, a first input connected to the pixel compensation data output, a second input connected to the pixel data output from the output register, and a selection input connected to the control circuit to select either the pixel compensation data or the pixel data output, wherein selection of the pixel data output causes the output register to hold previously selected compensation pixel data on the pixel data output.

8. A method for generating compensation pixel data, the method comprising:

comparing the values of pixel data of adjacent pixels to determine if they differ;

looking-up compensation pixel data in a look-up table if the values of pixel data differ between adjacent pixels;

selecting the compensation pixel data from the look-up table for output if the values of pixel data differ between adjacent pixels; and disabling the look-up table to save power and holding at an output previously selected compensation pixel data, if the values of pixel data for adjacent pixels are the same.

9. The method of claim 8, wherein the pixel data is in a stream of pixel data containing multiple adjacent values and the method further comprises repeating the comparing, looking-up, selecting and holding steps for each of the values in the stream of pixel data.

10. The method of claim 8 wherein the compensation pixel data are stored in a memory and step (b) comprises looking-up the compensation pixel data in the memory.

11. The method of claim 8, wherein the compensation pixel data is the pixel data adjusted by a gamma compensation value.

12. A system for generating compensation pixel data, the system comprising:

means for comparing the values of pixel data for adjacent pixels;

means for mapping the pixel data to compensation pixel data and supplying, when enabled, the compensation pixel data;

means for selecting for output the compensation pixel data from the mapping means when enabled or holding at the output previously selected compensation pixel data; and means, responsive to the comparing means, for enabling the mapping means and the selecting means when the values of pixel data of adjacent pixels differ, and disabling the mapping means to save power, when the values of pixel data of adjacent pixels are the same.

13. The system of claim 12, wherein the means for comparing adjacent pixel values is a comparator.

14. The system of claim 12, wherein the means for mapping the compensation pixel data is a look-up table.

15. The system of claim 12, wherein the means for enabling the mapping means and the selecting means is a control circuit.

16. The system of claim 12, wherein the means for comparing adjacent pixel values is a comparator and the means for mapping the compensation pixel data is a look-up table.

17. The system of claim 16, wherein the look-up table is a random access memory containing the compensation pixel data.

18. The system of claim 17, wherein the means for enabling the mapping means is a read signal to the random access memory.

19. The system of claim 18, wherein the pixel data is an address for the compensation pixel data in the random access memory.

20. The system of claim 19, wherein the compensation pixel data is the pixel data adjusted by a gamma compensation value for the pixel data.

* * * * *